US007252624B2

(12) United States Patent
Wu et al.

(10) Patent No.: US 7,252,624 B2
(45) Date of Patent: Aug. 7, 2007

(54) REGULATING APPARATUS FOR A HYDRAULIC CYLINDER OF A TREADMILL

(76) Inventors: Peter Wu, No. 1, Lane 233, Sec. 2, Charng Long Rd., Taiping (TW) 411; Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 62 days.

(21) Appl. No.: 10/843,470

(22) Filed: May 12, 2004

(65) Prior Publication Data

US 2005/0255970 A1 Nov. 17, 2005

(51) Int. Cl.
*A63B 22/02* (2006.01)

(52) U.S. Cl. ..... 482/54

(58) Field of Classification Search ..... 482/51, 482/54, 111, 112; 92/5 R, 261
See application file for complete search history.

(56) References Cited

U.S. PATENT DOCUMENTS 3,077,179 A * 2/1963 Evanson ..... 116/285
4,198,921 A * 4/1980 Horton ..... 116/283
4,478,412 A * 10/1984 Muir ..... 482/113
4,705,271 A * 11/1987 Mondloch et al. ..... 482/112
5,071,115 A * 12/1991 Welch ..... 482/53
5,190,505 A * 3/1993 Dalebout et al. ..... 482/52
5,336,146 A * 8/1994 Piaget et al. ..... 482/54
5,762,587 A * 6/1998 Dalebout et al. ..... 482/53
5,799,758 A * 9/1998 Huang ..... 188/285
6,044,940 A * 4/2000 Marzocchi et al. ..... 188/299.1
6,317,922 B1 * 11/2001 Kondratuk ..... 16/72
6,953,419 B2 * 10/2005 Wang et al. ..... 482/54
2004/0192512 A1 * 9/2004 Kuo ..... 482/54

* cited by examiner

*Primary Examiner*—Stephen K. Cronin
*Assistant Examiner*—Tam Nguyen
(74) *Attorney, Agent, or Firm*—Kuo-Hsiung Chiu

(57) ABSTRACT

A regulating apparatus for a hydraulic cylinder of a treadmill having a rotating knob with an opening formed at a top end thereof and with a neck formed at a bottom end thereof. The periphery of the neck is marked with a plurality of numbers or with colors from light to dark. An annular base includes a ring-shaped gap for dividing it into an internal and external side. The external side has a viewing window extending to the ring-shaped gap. A magnifying glass is received within the viewing window. Moreover, the internal side of the annular base is fixed atop the hydraulic cylinder. In addition, the rotating knob is fixed on the annular base in such a manner that an adjusting post projects from the opening of the regulating knob and the neck is inserted into the ring-shaped gap. Therefore, the number or the color disposed on the neck is visible from the viewing window when the cushioning force of the hydraulic cylinder is adjusted.

2 Claims, 3 Drawing Sheets

REGULATING APPARATUS FOR A HYDRAULIC CYLINDER OF A TREADMILL

BACKGROUND OF THE INVENTION

1. Fields of the Invention

The invention relates to an apparatus for regulating the cushioning effect to a walking platform of a treadmill, and more particularly, to a regulating apparatus with which the cushioning level can be visually identified.

2. Description of the Related Art

Treadmill is an exercise device consisting of an endless belt on which a person can walk or jog without changing place. During the exercise session, the feet of the operator will receive reactive force created by a walking platform of the treadmill when they tread thereon.

In order to reduce exercise injuries, a hydraulic cylinder is commonly employed to cushion the reactive force. Since every operator has his own body weight, the reactive force to be cushioned is different. Therefore, to install an adjustable hydraulic cylinder is an optimal solution to overcome the aforementioned problem.

A conventional hydraulic cylinder 10, as shown in FIG. 4, has an lower ear 11 and an adjusting post 12 at a bottom and top end thereof, respectively. A cylinder shaft 13 is extended from the adjusting post 12. An upper ear 14 is formed at a free end of the cylinder shaft 13. Moreover, a knob 15 with an opening 16 atop in the middle thereof is provided. The knob 15 with its opening can be tightly fixed on the adjusting post 12. Meanwhile, a scale is fitted around the top of the hydraulic cylinder 10, and the knob 15 has an arrow-shaped protrusion for indicating a certain cushioning strength of the hydraulic cylinder 10.

However, the scale and the arrow can become invisible due to impurities stuck thereto or due to wearing action thereon, thereby resulting in much inconvenience in use.

SUMMARY OF THE INVENTION

It is a primary object of the invention is to provide a regulating apparatus for a hydraulic cylinder of a treadmill with which the cushioning level can be visually identified.

Another object of the invention is to provide a regulating apparatus for a hydraulic cylinder of a treadmill that includes a magnifying glass disposed within the viewing window for magnifying the numbers marked on the neck of the rotating knob and, therefore, for facilitating the reading of the numbers.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
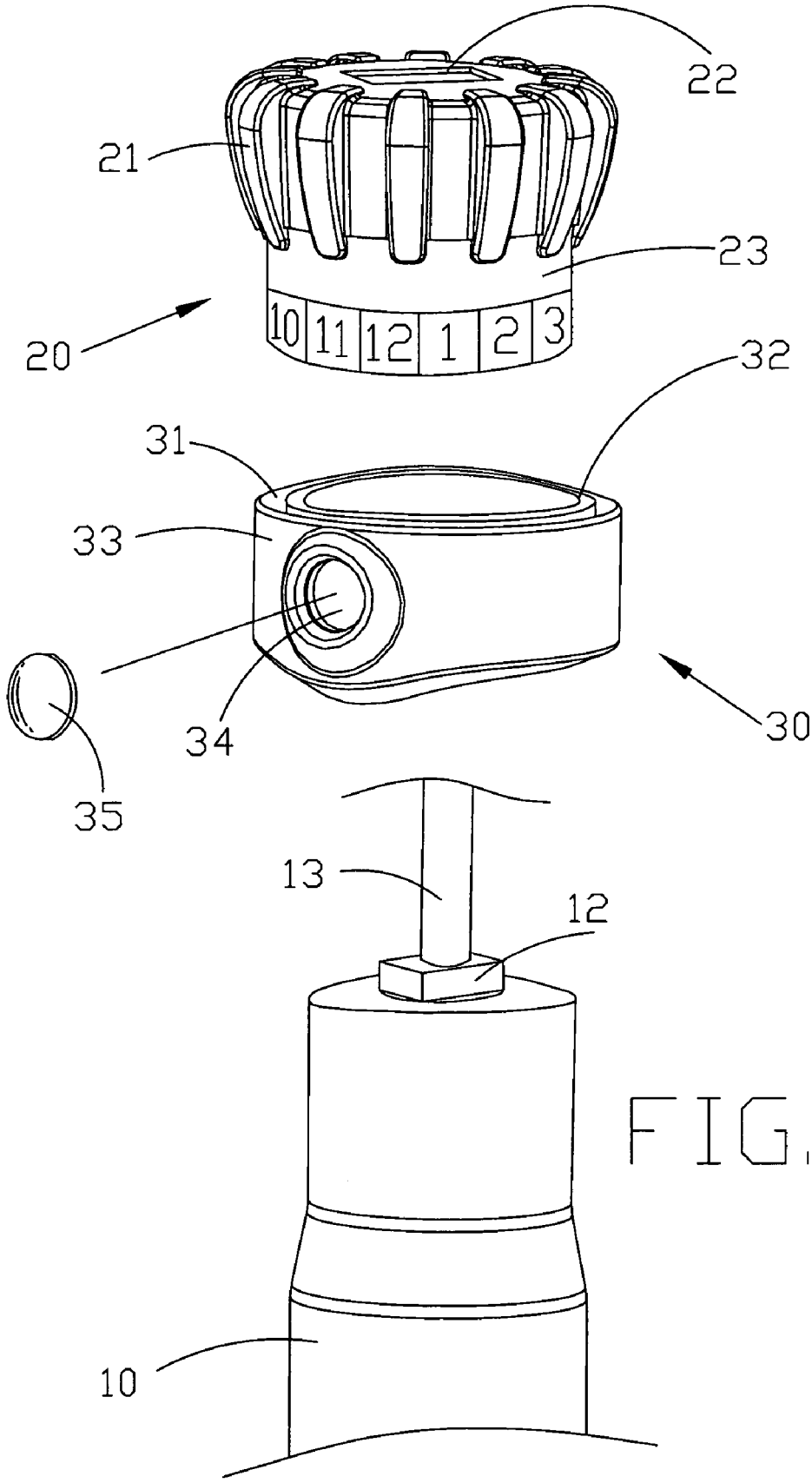
FIG. 1 is an exploded view of a regulating apparatus of the invention.
Figure 2:
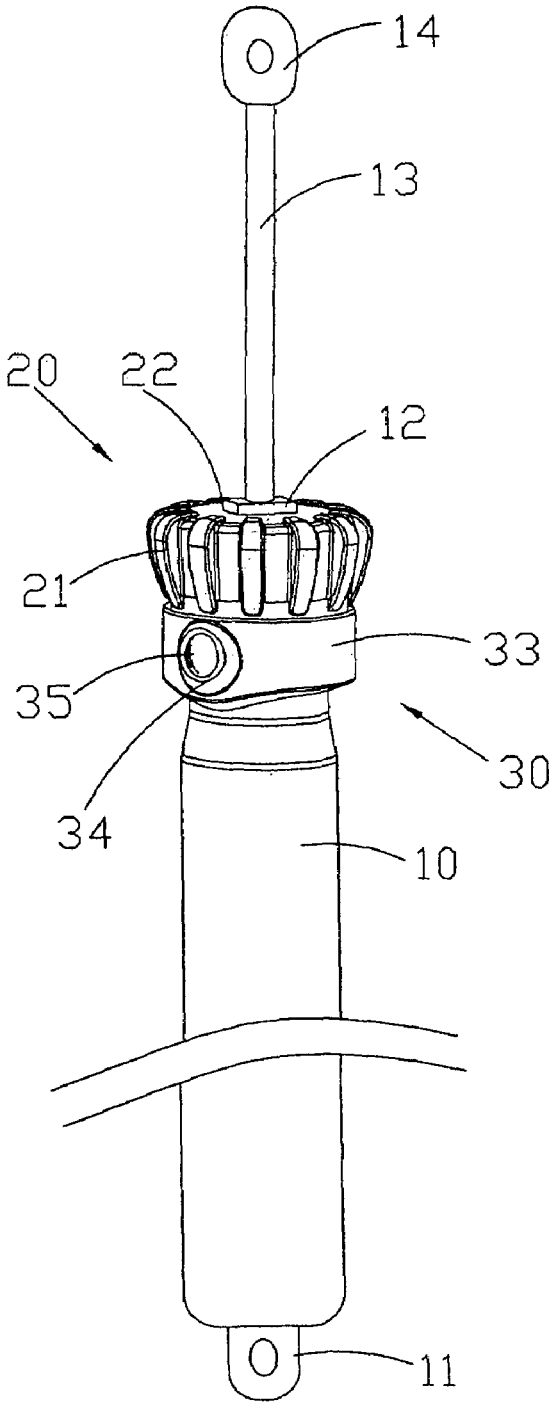
FIG. 2 is a perspective view of the regulating apparatus in accordance with FIG. 1 fixed atop a hydraulic cylinder.
Figure 4:
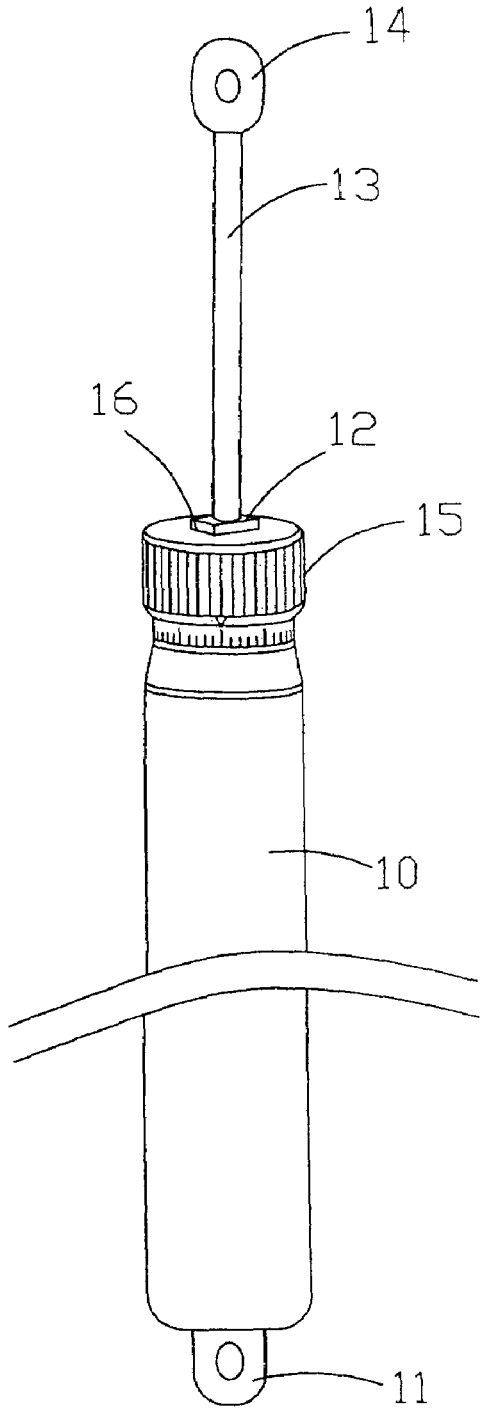
FIG.4 (Prior Art)
FIG. 4 is a perspective view of a conventional hydraulic cylinder.

Referring to FIG. 1, a regulating apparatus 20 in accordance with the invention includes a rotating knob 21 with an opening 22 formed at a top end thereof and with a neck 23 formed at a bottom end thereof. The periphery of the neck 23 is marked with a plurality of numbers or with colors from light to dark. An annular base 30 includes a ring-shaped gap 31 for dividing the annular base 30 into an internal side 32 and an external side 33. The external side 33 has a viewing window 34 extending to the ring-shaped gap 31. A magnifying glass 35 is received within the viewing window 34.

In assembly, the internal side 32 of the annular base 30 is fixed on the top of the hydraulic cylinder 10. The annular base 30 and the hydraulic cylinder 10 are tightly joined together in a body by sticking, gluing, hot-melting, etc. Thereafter, the rotating knob 21 is fixed on the annular base 30 in such a manner that an adjusting post 12 just projects from the opening 22 of the regulating knob 20 and the neck 23 is inserted into the ring-shaped gap 31. Therefore, the number or the color disposed on the neck 23 and magnified by the magnifying glass 35 is readable from the viewing window 34. In this way, the cushioning force of the platform of a treadmill can be adjusted to a desired value by the regulating apparatus 20.

Figure 3:
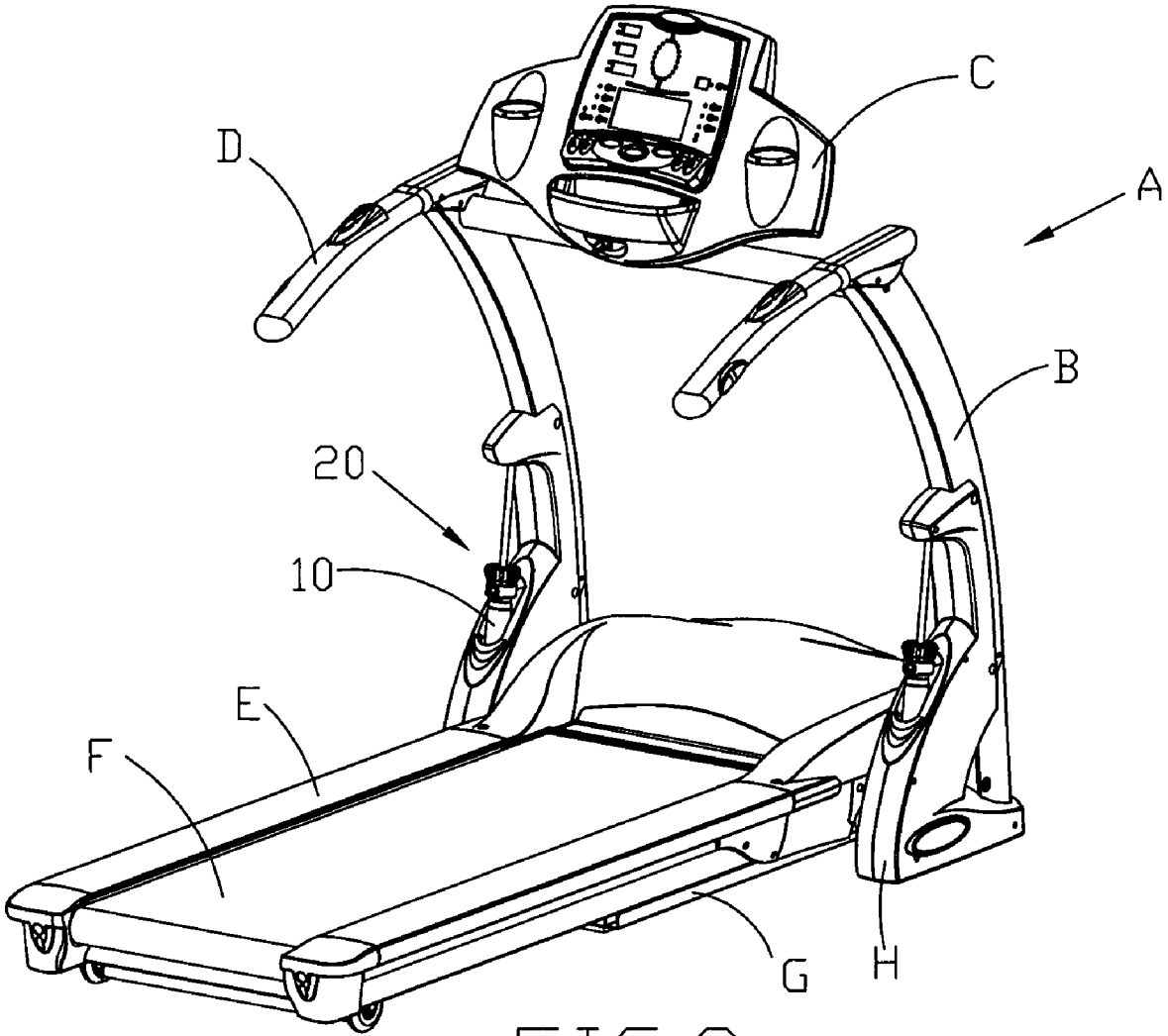
FIG. 3 is a perspective view of the hydraulic cylinder of FIG. 2 that is installed in a treadmill.

Referring to FIG. 3, a conventional treadmill A with supporting frames B, an electric control console C and handles is shown. The height of the platform E and the rotational speed of an endless belt F is adjustable. Moreover, a cushioning seat H is provided at both sides of a base frame G, respectively. The hydraulic cylinder 10 with the regulating apparatus 20 of the invention can be installed in the cushioning seat H for providing a cushioning action on the platform E. This enables a protection of operator's feet from injuries by lowering the reactive force of the platform.

Based on the above-mentioned, the invention has following advantages:

1. The cushioning strength is easily identified by sight.
2. The value of the cushioning strength can be magnified for an easy identification.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A regulating apparatus for a hydraulic cylinder of a treadmill comprising:

a) a rotating knob with an opening formed on a top portion thereof and with a neck formed at a bottom end thereof, the periphery of the neck being marked with a plurality of numbers or with colors from light to dark; and b) an annular base having a ring-shaped gap for dividing the annular base into an internal side and an external side, the external side having a viewing window extending to the ring-shaped gap, a glass being received within the viewing window, the internal side of the annular base can be fixed on a top end of a hydraulic cylinder, the hydraulic cylinder having an adjusting post that projects through the opening of the rotating knob while the neck of the rotating knob is inserted into the ring-shaped gap;

whereby the numbers or the colors disposed on the neck are visible from the viewing window when the adjusting post is rotated with the rotating knob for adjusting the hydraulic cylinder's cushioning force.

2. The regulating apparatus for a hydraulic cylinder of a treadmill of claim 1 wherein the glass disposed within the viewing window is a magnifying glass for magnifying the numbers or colors marked on the neck of the rotating knob and, therefore, for facilitating the reading of the numbers or colors.

* * * * *